United States Patent [19]

Andrus

[11] 3,942,943

[45] Mar. 9, 1976

[54] GRAVITY FLOW DISCRETE ARTICLE GAS FLOW ISOLATED THERMAL TREATMENT DEVICE

[76] Inventor: Everett Howard Andrus, Rte. No. 4, Watertown, Wis. 53094

[22] Filed: Nov. 26, 1974

[21] Appl. No.: 527,447

Related U.S. Application Data

[63] Continuation-in-part of Ser. No. 449,364, March 8, 1974, Pat. No. 3,850,572.

[52] U.S. Cl. ..... 432/121; 432/11; 432/144; 432/150

[51] Int. Cl.[2] ..... F27B 9/00

[58] Field of Search ..... 432/11, 134, 121, 143, 432/144, 145, 148, 149, 150

[56] References Cited

UNITED STATES PATENTS

| | | | |
|---|---|---|---|
| 3,168,298 | 2/1965 | Cook et al. | 432/145 |
| 3,415,505 | 12/1968 | Cook | 432/11 |
| 3,850,572 | 11/1974 | Andrus | 432/11 |

*Primary Examiner*—John J. Camby
*Attorney, Agent, or Firm*—John M. Diehl

[57] ABSTRACT

Small articles such as springs are heat treated as they flow downward by gravity through a straight cylindrical tube. The tube need not be cylindrical or straight and means to assist gravity may be provided. The articles are heated by hot air or other gas introduced to said tube through apertures in its walls and which flows through portions of the tube at high velocity. Hot air thus introduced is withdrawn through other apertures in the walls of the tube in a manner to prevent heat loss by exhaust of the hot air at either end of the tube or by introduction into the tube of ambient cool air at either end of the tube.

8 Claims, 7 Drawing Figures

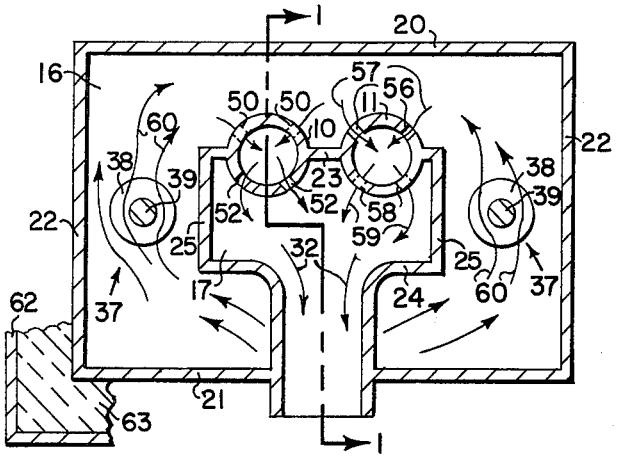
Fig. 2.
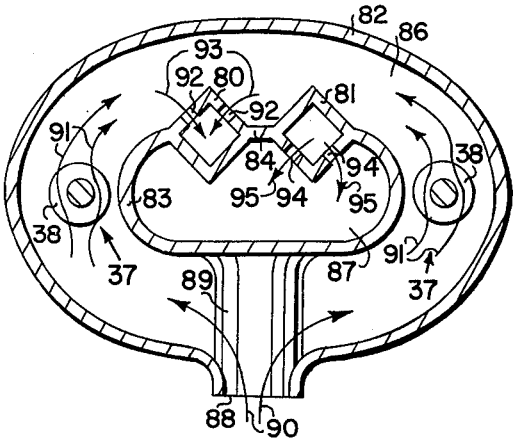
Fig. 3.
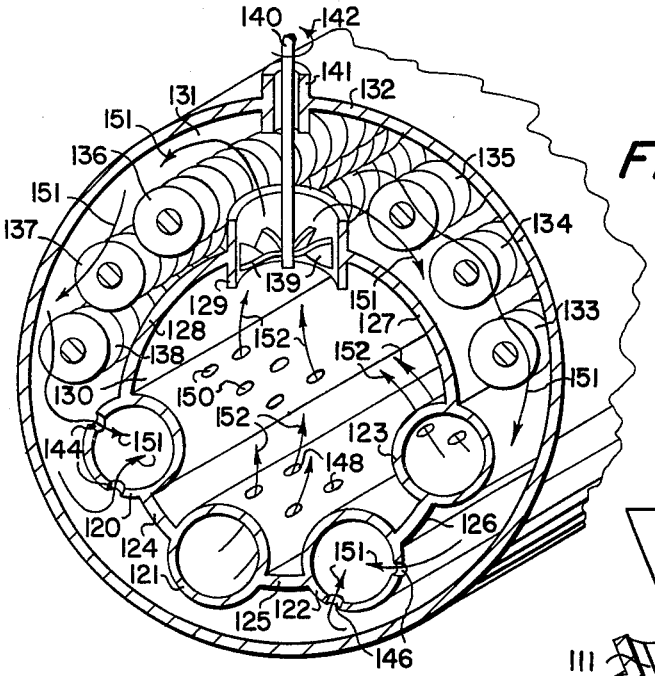
Fig. 5.
Fig. 4.
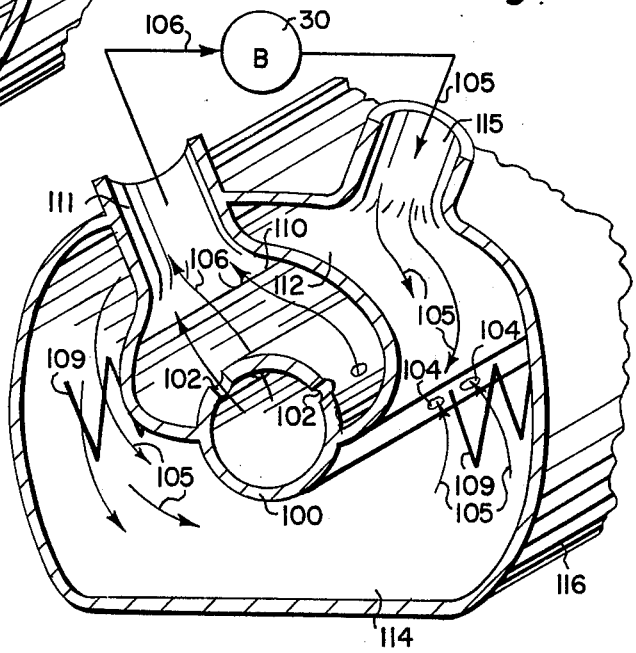

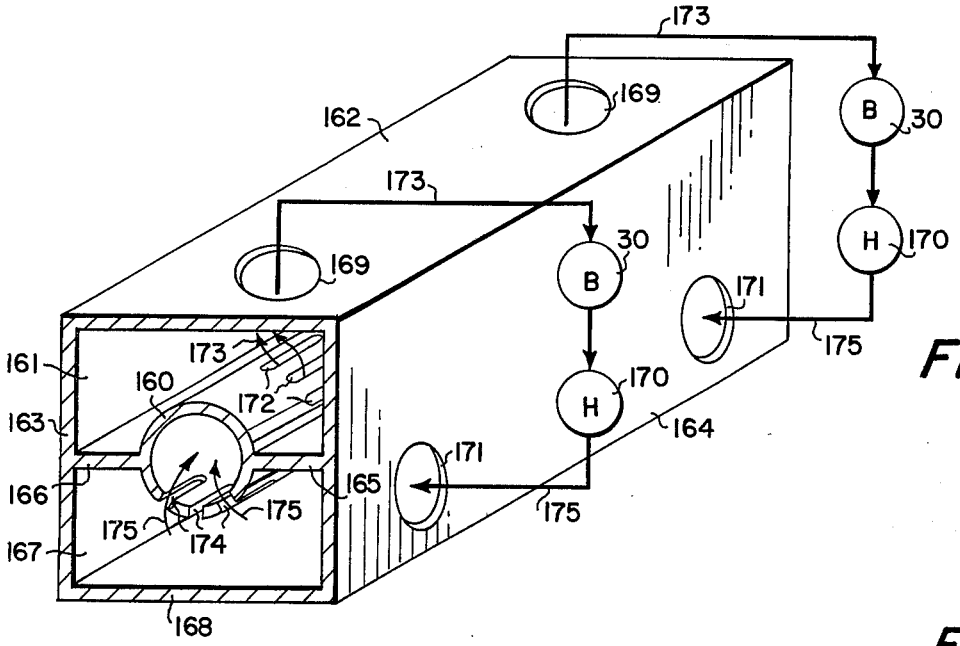
Fig. 6.
Fig. 7.
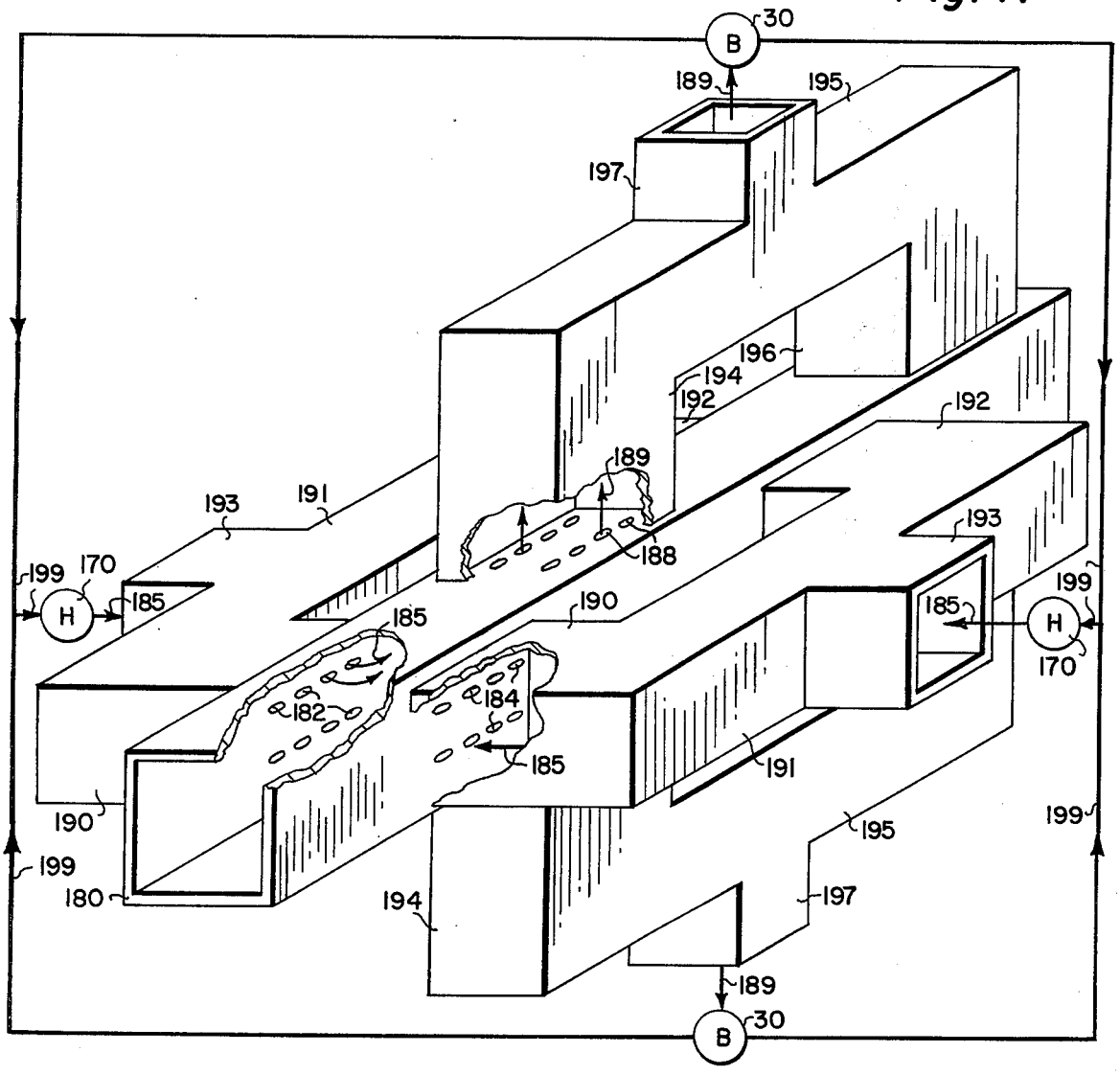

GRAVITY FLOW DISCRETE ARTICLE GAS FLOW ISOLATED THERMAL TREATMENT DEVICE

CROSS-REFERENCES

This application is a continuation-in-part application of application Ser. No. 449,364 filed Mar. 8, 1974, now U.S. Pat. No. 3,850,572, having the same title.

FIELD

This invention relates to a furnace or oven or heating apparatus and more particularly to such apparatus for heat treating small articles by passing heated air thereover.

PRIOR ART

The invention is an improvement over the disclosures of the following patents:

| | | |
|---|---|---|
| 1,643,775 | 9/27/27 | J. Kelleher |
| 3,115,818 | 12/31/63 | R. A. Smith |
| 3,293,879 | 12/27/66 | H. Van Eikeren |
| 3,346,247 | 10/10/67 | L. Talalay et al |
| 3,351,329 | 11/7/67 | D. W. Thomas |
| 3,437,321 | 4/8/69 | D. M. Wilkinson |
| 3,448,969 | 6/10/69 | C. A. Windsor |
| 3,456,930 | 7/22/69 | Kunio Saeki et al |
| 3,467,366 | 9/16/69 | H. W. Westeren et al |
| 3,650,042 | 3/21/72 | Boerger et al |
| 3,659,551 | 5/2/72 | McKinstry |

U.S. Pat. Nos. 3,351,329 and 3,467,366 describe use of venturi apparatus to provide isolation of the atmosphere within the furnaces described therein from the ambient atmosphere, unlike the device of the present invention.

The other above listed patents likewise describe various means for providing isolation of the atmosphere within a furnace from the ambient atmosphere; each is distinguished from the apparatus of the instant invention as will be apparent from the following detailed description.

SUMMARY AND BACKGROUND

Small articles such as springs, fasteners, twist drills and the like have traditionally and conventionally been heat treated by placing the articles in a perforated metal box and placing the box in a furnace into which heated air or other gas is introduced or by placing the articles in a rotating drum provided with heated air or other gas in the interior thereof.

Such articles or devices (especially springs and many fasteners) are often characterized by a tendency to become entangled when placed helter skelter into a container. Normally hand labor is required to separate such devices which have been heat treated in bulk in the manner of the prior art and generally an excessive and even stupendous cost factor is thereby added to the overall cost of producing the part. For example, it has been not uncommon for the cost of carrying out this single step in the manufacture of a spring to outweigh or be larger than the total of all other costs in the manufacture of the spring, including cost of materials, cost of original manufacture of the spring, all costs of transportation and even the cost of installing the spring in the final device for which it is destined which can often be done automatically by robot-type machinery. That which is true for such springs is also true for many other metal wire parts and spring steel fasteners and fastener parts.

Generally throughout the remainer of this specification reference will be had to springs. But it is to be understood that such reference to springs is intended to include other small articles or parts to which the invention may apply, including for example but not limited to spring steel fasteners, spring steel fastener parts, twist drills, bifurcated rivets and hollow rivets, the heat treating of which is required as a step in the manufacture thereof.

The device of the present invention is normally adapted to be located immediately adjacent a spring coiler, that is, a spring manufacturing machine, so that as each spring manufactured by the spring coiler is ejected from the coiler or falls from the coiler it is introduced by gravity or by the force of the ejection from the machine into the device of the invention.

In the device of the invention at least one tube (usually two tubes) is provided in which the springs travel vertically downward or at an angle downwardly. The tube is preferably straight and cylindrical but for parts other than coil springs may have any other suitable configuration. Springs form a column or stack of springs within the tube of the device, the lowermost spring being supported by a release mechanism provided at the lower extremity of the device and the remainder of the springs in the column or stack being supported by one another. The release mechanism releases a spring from the bottom of the heat treating device of the invention for each spring introduced at the top of the device so that the rate of release of the springs from the heat treating device exactly corresponds to the rate of introduction of the springs to the heat treating device.

Generally the springs travel downwardly through a tube of the device due to the force of gravity acting thereon but in certain instances, generally in those instances wherein the tube is relatively long and inclined at a relatively small angle to the horizontal, means to vibrate the tube or to vibrate the entire device and thereby vibrate the tube may be provided to assist gravitational force to cause the springs to travel downwardly therethrough.

OBJECTS

It is therefore an object of the invention to provide an improved heat treating device.

Another object is such an improved device for heat treating small entangleable parts without entanglement thereof.

Another object is such a device wherein the parts travel in a column through a tubular portion of the device.

Another object is such a device wherein heating of the articles to be heat treated is provided by high velocity hot gas traveling in said tubular portion.

Another object of the invention is such a device wherein heating of each article to the temperature of heat treatment occurs very rapidly and very near the point of entry of the article into the device.

Another object of the invention is such a device wherein the ends of said tubular portion are open to the ambient atmosphere and yet no heat loss or gain and no exchange of said heated gas with the gas of the ambient atmosphere takes place.

Another object is such a device which may be made relatively short.

Other objects will become apparent from the drawings and from the following detailed description.

DRAWINGS

In the figures like reference numerals refer to like parts and:

FIG. 2 is a schematic cross-sectional view of the embodiment of FIG. 1 corresponding to a view which would be taken of the entire embodiment of FIG. 1 on lines 2—2 in FIG. 1;

FIG. 3 is a cross-sectional view of a modification of the embodiment of FIGS. 1 and 2 taken of the entire embodiment from the viewpoint indicated by lines 3—3 in FIG. 1;

FIG. 4 is a schematic cross-sectional fragmentary perspective view of another modification of the embodiment of FIGS. 1 and 2, comprising a single heat-treating tube;

FIG. 5 is a schematic cross-sectional perspective fragmentary view of still another modification of the embodiment of FIGS. 1 and 2 which comprises four heat treating tubes and six heating elements;

FIG. 6 is a schematic cross-sectional perspective fragmentary view of another embodiment; and FIG. 7 is a schematic cross-sectional partially cutaway perspective view of yet another embodiment.

DESCRIPTION

Figure 1:
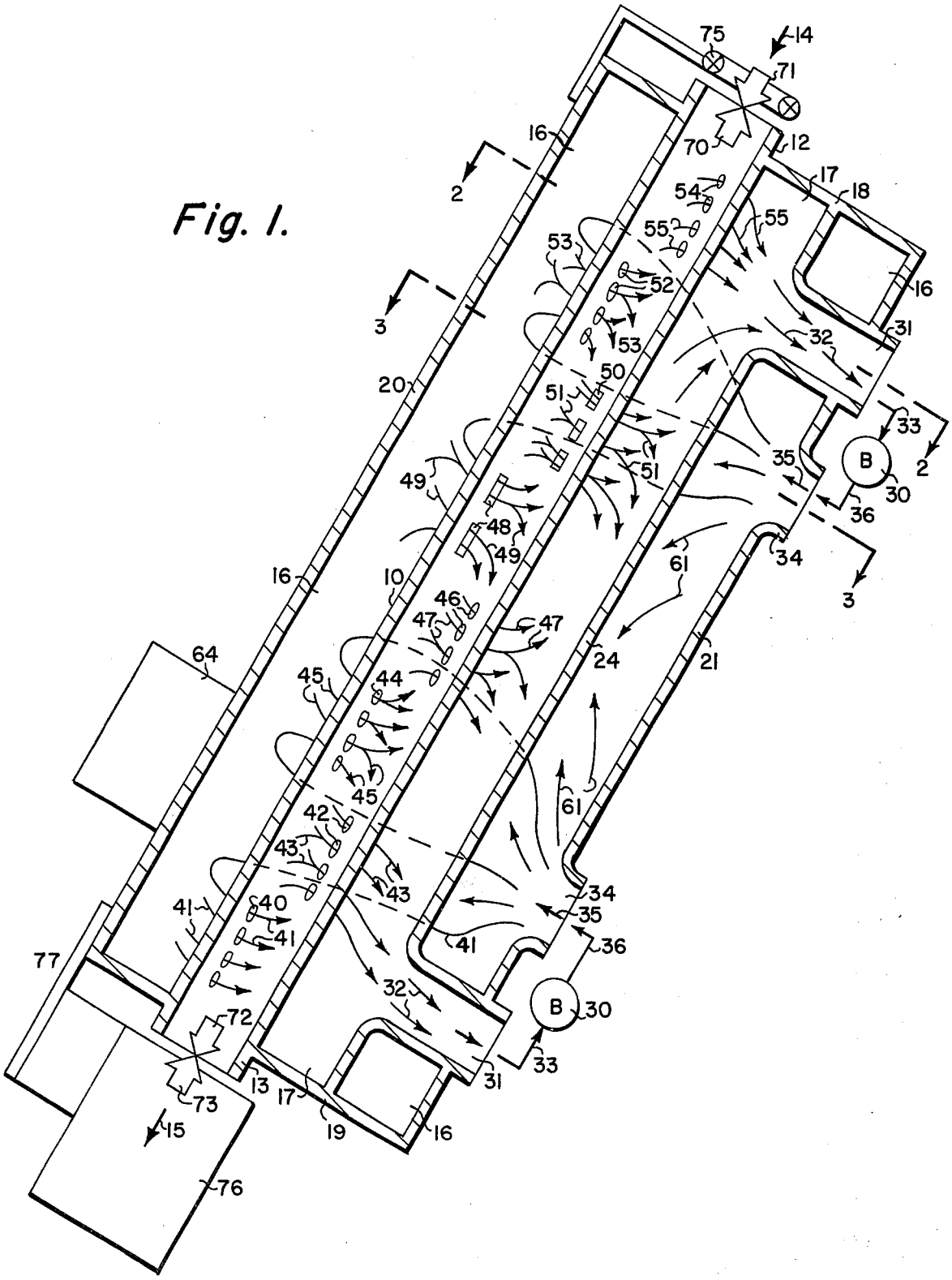
FIG. 1 is a schematic cross-sectional view of a preferred embodiment of the invention taken from the aspect of lines 1—1 in FIG. 2.

Referring now to FIGS. 1 and 2, a device in accordance with the invention may comprise two heat treating tubes or tubular members 10 and 11, each of which may have an inlet end as indicated at 12 and an outlet end as indicated at 13. A plurality of small articles such as any one of the springs (or other parts) mentioned in U.S. Pat. No. 3,850,572 may be introduced into tubes 10 and 11 at their inlet ends 12 as indicated at arrow 14, may travel through tubes 10 and 11 and may exit from tubes 10 and 11 at ends 13 as indicated by arrow 15. First plenum chamber 16 and second plenum chamber 17 share common or co-extensive end walls 18 at the inlet end and 19 at the outlet end. Plenum 16 may be defined by walls 18 and 19 and by top wall 20, bottom wall 21 and side walls 22. Plenum 17 may be defined by walls 18 and 19, tubes 10 and 11, wall 23 extending between tubes 10 and 11, bottom wall 24 and side walls 25.

Blowers 30 may be provided to withdraw gas from plenum 17 through ducts 31 as indicated by arrows 32 and 33 and to introduce the withdrawn gas into plenum 16 through ducts or openings 34 as indicated by arrows 35 and 36. Heating elements indicated generally as 37 may be disposed longitudinally in plenum 16 and may be of the fin-tube type and thus may comprise fins 38 and central core or tube 39.

A group of apertures 40 may be provided in a wall of tube 10 and may communicate between the interior of tube 10 and plenum 16 to provide for introduction of heated gas from plenum 16 into the interior of tube 10 as indicated by arrows 41.

A group of apertures 42 may be provided in a wall of tube 10, spaced longitudinally in said tube with respect to the group of apertures 40 and may communicate between the interior of tube 10 and plenum 17 to provide for withdrawal of heated gas from the interior of tube 10 into plenum 17 and thence to blowers 30 as indicated by arrows 43.

A group of apertures 44 may be provided in a wall of tube 10 and may be longitudinally spaced with respect to apertures 42 as shown. Apertures 44 may provide communication between plenum 16 and the interior of tube 10 to provide for introduction of gas from plenum 16 into tube 10 as indicated by arrows 47. Said gas may travel from blowers 30 as indicated by arrows 61 and travel between fins 39 of heaters 37 as indicated by arrows 60.

A group of apertures 46 may be provided, spaced longitudinally from group 44 in a wall of tube 10 and communicating the interior of tube 10 to plenum 17, to provide for withdrawal of heated gas from the interior of tube 10 to plenum 17 as indicated by arrows 47.

A group of apertures 48 may be provided in a wall of tube 10, spaced longitudinally from group 46 and communicating between plenum 16 and the interior of tube 10, to provide for introduction of heated gas, heated by heaters 37, from blowers 30 to the interior of tube 10.

Whereas apertures 40, 42, 44 and 46 have been shown as round holes, apertures 48 are shown as elongated rectangular holes or slots. The particular shape of the apertures is not limiting and may not only be round but may be oval or elongated or triangular, hexagonal or the like. The flow of gas through apertures 48 is indicated by arrows 49.

Apertures 50 may be provided in a wall of tube 10, longitudinally spaced from group 48, to provide communication between the interior of tube 10 and plenum 17 to provide for withdrawal of heated gas from the interior of tube 10 to plenum 17 and thence to blowers 30 as indicated by arrows 31 and 32.

A group of apertures 52, spaced longitudinally from group 50 may be provided in a wall of tube 10 to provide for introduction of gas heated by heaters 37 from plenum 17 to the interior of tube 10 as indicated by arrows 53 and group 54 of apertures in the wall of tube 10 may provide for flow of gas from the interior of tube 10 to plenum 17 and thence to blowers 30 as indicated by arrows 55.

Apertures 56 in tube 11 are part of a group of apertures providing communicating between plenum 16 and the interior of tube 11 and providing for introduction of heated gas from the interior of plenum 16 into the interior of tube 11 and apertures 58 which are longitudinally displaced in tube 11 from apertures 56 may be part of a group of apertures communicating between the interior of tube 11 and plenum 17 to provide for withdrawal of gas from the interior of tube 11 into plenum 17. Apertures which serve the same functions in tubes 10 and 11 need not correspond in longitudinal position in these tubes. Thus apertures 56 and apertures 50 in tubes 11 and 10 respectively, which correspond in function, are not in the same respective longitudinal positions in tubes 11 and 10 as is shown in FIG. 2 wherein orifices 56 are shown in cross-section but orifices 50 are displaced longitudinally from the plane in which the cross-section is taken. Likewise, orifices 58 and 52 in tubes 11 and 10 respectively serve the same function but apertures 52 are properly shown in full cross-section in FIG. 2 whereas apertures 58 are displaced longitudinally from the plane in which the cross-section is taken.

It may be observed that the direction of flow of gas within tube 10 over and around parts which may be disposed within tube 10 to be heat treated has both significant laterial components and significant longitudinal components by reason of the longitudinal spacing in tube 10 of each group of apertures which provide for withdrawal of gas therefrom from each group of apertures which provide for introduction of gas thereto and by reason of providing the apertures which provide for withdrawal of gas from the interior of tube radially with respect to the apertures which provide for introduction of gas to tube 10.

Apparatus heretofore described including, if desired, blowers 30 may desirably be mounted within a housing 62 indicated fragmentarily in FIG. 2 and may be provided with insulating material 63 between housing 62 and walls 18, 19, 20, 21 and 22 as indicated fragmentarily at 63 in FIG. 2.

Housing 62 may be provided with means such as described in U.S. Pat. No. 3,850,572 to provide for attaching the device to an upright or vertically extending post or any other suitable mounting or to provide for disposing the device at any suitable angle. It is generally preferred to mount and operate the device at a slant as indicated in FIG. 1 and shown in FIGS. 1 and 2 of U.S. Pat. No. 3,850,572 but the device may be operated and mounted vertically and also may be operated and mounted horizontally. In the case of horizontal mounting or mounting at an angle near horizontal, gravity cannot be depended upon or cannot wholly be depended upon to provide for flow of articles to be heat treated through the tubes of the device such as tubes 10 and 11 and accordingly a vibrating device 64 may be provided attached to wall 20 as shown or attached to housing 62 or to any portion of the device to provide for vibratory feeding of articles to be heat treated through the heat treating tubes of the device.

As a critical feature of the method and device of the invention, size of the apertures and the number of apertures in each of groups 40, 42, 44, 46, 48, 50 and 52 and 54 of apertures are so chosen and adjusted as to provide for zero or nil outflow of gas from the interior of tube 10 at inlet end 12 as indicated by arrow 70 and to provide for zero or nil inflow of ambient atmospheric air into the interior of tube 10 at end 12 as indicated by arrow 71 and likewise to provide for zero or nil outflow of air from the interior of tube 10 at end 13 as indicated by arrow 72 and to provide for zero or nil inflow of ambient atmospheric air into the interior of tube 10 at end 13 as indicated by arrow 73.

Walls 23, 24 and 25 and tubes 10 and 11 may be supported within plenum 16 by end plates 18 and 19 and by the walls of ducts 31. End plates 18 and 19 need not be co-extensive as shown and may thus provide a lesser degree of support. Since it is necessary that tubes 10 and 11 extend through walls 18 and 19, walls 18 and 19 therefore provide support to the degree that they are in contact with the walls of tubes 10 and 11 but additional supporting members extending between walls 23, 24 and 25 on the one hand and walls 20, 21 and 22 on the other hand may be provided in the manner and to the degree desired, provided such support members do not interfere overmuch with the flow of gas within plenum 16 indicated by the arrows hereinbefore described.

Device 75 which may have the form of a hollow cylinder or other annular form as shown may be disposed adjacent end 12 of tube 10 (and a corresponding device may be disposed adjacent the entrance end of tube 11) so that each article or spring as it enters the interior of each of tubes 10 and 11 must pass through the center of one of devices 75. Each of devices 75 may be suitably constructed to indicate the presence of each spring or article as it passes therethrough. For example, device 75 may provide an electrical or magnetic field, one of the properties of which, such as capacitance or inductance, may be changed by a spring or other article passing through the device 75 and device 75 may generate and emit a signal in response to such change to indicate the presence of an article therein. This signal may be transmitted by conductors not shown to conventional apparatus not shown which may send another signal in response to such signal to the release mechanism indicated schematically at 76 which may be attached to housing 62 or to wall 20 as shown, by bracket 77, to provide one of devices 76 adjacent each of ends 13 of tubes 10 and 11. Each of devices 76 may provide for release of a spring or other part from end 13 of each of tubes 10 and 11 in response to a signal emitted from a corresponding device 75 as more fully described for such mechanisms in connection with FIGS. 13, 14 and 15 in U.S. Pat. No. 3,850,572.

The temperature regimens of the heat treating of springs and other articles in the device are preferably similar to those described in connection with the curves shown in FIGS. 16, 19 and 20 of U.S. Pat. No. 3,850,572, that is, generally the springs are heated relatively rapidly to the desired temperature and then maintained at the desired temperature for a suitable length of time to accomplish the desired heat treating, as they pass through each of tubes 10 and 11.

Although each of tubes 10 and 11 is shown as being round in cross-section, that is, cylindrical, any one or more of these tubes may have any other suitable cross-sectional shape such as that of a square, triangle, hexagon, octagon or any regular or irregular polygon.

Thus, as shown in FIG. 3, heat treating tubes 80 and 81 are square in cross-section and are particularly well adapted for heat treating so-called square springs or other metal articles having a profile, when viewed from the end, suitable for being received in a square tube.

Plenum 86 may correspond to plenum 16 but instead of being defined by top and bottom walls and side walls which provide a rectangular cross-section, plenum 86 may be defined by a curvilinear wall 82 to provide a curvilinear cross-sectional shape shown in FIG. 3. Plenum 86 may be provided with one or more openings 88 which may correspond to openings 34 in plenum 16, which may communicate with one or more blowers such as blowers 30 which are not shown for simplicity.

Heaters 37 having fins 38 may be provided in plenum 86.

Plenum 87 may correspond to plenum 17 and be defined by wall 84 extending between tubes 80 and 81, by said tubes themselves and by curvilinear wall 83 which may provide the cross-section shown instead of the rectilinear cross-section shown in FIGS. 1 and 2 for plenum 17. Plenum 87 may be provided with ducts 89 communicating the interior thereof to blowers such as blowers 30, not shown for simplicity, which may be disposed to withdraw gas from plenum 87 and introduce said gas through openings 88 to plenum 87. As shown by arrows 90, said gas may then be heated by passing over fins 38 as indicated by arrows 91 and may then be introduced into the interiors of tubes 80 and 81 through apertures such as apertures 92 as indicated by arrows 93 and may then pass over parts to be heat treated in the interior of tubes 80 and 81 and be withdrawn from the interiors of tubes 80 and 81 into plenum 87 through communicating apertures such as apertures 94 as indicated by arrows 95.

Tube 81 may be provided with apertures which correspond to and serve the same function as apertures 92 in tube 80 but such apertures may be displaced longitudinally in tube 81 with respect to those in tube 80 as described for orifices 50 and 56 in the embodiment of FIGS. 1 and 2. Likewise tube 80 may be provided with apertures which serve the function of and correspond to apertures 94 in tube 81 but which are displaced longitudinally with respect to apertures 94 and therefore are not shown in the cross-sectional view of FIG. 3. Apertures such as apertures 92 and 94 provided in tubes 80 and 81 are provided in longitudinally displaced groups as hereinbefore described for groups of apertures 40, 42, 44, 46, 48, 50, 52 and 54 in tube 10 in the embodiment of FIGS. 1 and 2.

Tubes 80 and 81 and walls 84 and 83 defining plenum 87 may be supported within plenum 86 by the walls of ducts 89 and by end plates corresponding to end plates 18 and 19 in the embodiment of FIGS. 1 and 2 but the end plates need not be co-extensive and support for these members may be provided by additional members which are not shown for simplicity.

Referring now to FIG. 4 there is shown an embodiment which comprises only a single heat treating tube 100. Tube 100 is provided with apertures 102 which constitute a portion of a group of orifices and which communicate between the interior of tube 100 and the interior of plenum 110 having duct 111 extending therefrom. Plenum 110 may be defined in part by wall 112 which may support tube 100 and may be supported by walls of one or more of ducts 111 or by other means, not shown for simplicity, or both within plenum 114 which may have one or more ducts or openings 115 in walls 116 which may be of curvilinear form as shown. Tube 100 may be provided with a group of apertures 104 communicating between plenum 114 and the interior of tube 100 and displaced longitudinally from the group of apertures represented by apertures 102.

Electrical heating elements 109 may be provided in plenum 114 and may be heated electrically from a source and through conductors not shown for simplicity. Air or other gas may be withdrawn from the interior of tube 100 through apertures 102 into the interior of plenum 110 and thence through duct 111 to blower 30 as indicated by arrows 106 and may then be driven by blower 30 through duct 115 and plenum 114 and thence through apertures 104 into the interior of tube 100 as indicated by arrows 105. Tube 100 may be provided with additional groups of apertures corresponding to apertures 102 and 104 which may be longitudinally displaced from one another as described for the apertures provided in tube 10 in the embodiment of FIGS. 1 and 2 to provide significant longitudinal and lateral components of heated gas flow over the parts contained within tube 100 during heat treating.

The number and size and shape of apertures in tube 100 such as apertures 102 and 104 and the number of apertures in each group and the positioning of the apertures in each group and the positioning of the groups in tube 100 are suitably selected to provide nil outflow of gas from the interior of tube 100 at its ends to the exterior and nil outflow of ambient air into tube 100 at its ends in the manner described in connection with arrows 70, 71, 72 and 73 in the embodiment of FIGS. 1 and 2.

Referring now to FIG. 5, an embodiment is shown which illustrates that the invention is not limited as to the number of heat treating tubes that may be provided in a single embodiment in accordance with the invention and is not limited as to the number of heaters which may be utilized in a single embodiment in accordance with the invention. FIG. 5 also illustrates that the portions of blowers which move the gas in the device in accordance with the invention may be disposed entirely within the outer plenum. Thus heat treating tubes 120, 121, 122 and 123, together with wall portions 124, 125, 126, 127 and 128, define a plenum 130 may form portions of a circle when viewed in cross-section. Openings 129 may be provided in walls 127 and 128 communicating the interior of plenum 130 with the interior of plenum 131 which may be defined by cylindrical wall 132. The axes of cylinder 132 and the circle defined by walls 127, 128, 124, 125 and 126 when viewed in cross-section may if desired be co-axial but may, as shown, be displaced from each other. The axes are preferably parallel to each other as shown. Longitudinally extending heating devices 133, 134, 135, 136, 137 and 138 may be provided in plenum 131 and may be heated electrically through conductors from a source not shown for simplicity.

An axial flow blower may be provided comprising veins 139 disposed in opening 129 and attached to shaft 140 which may be rotatably received in a suitable opening 141 in wall 132 and may be rotationally driven in the manner indicated by arrow 142 by a motor not shown for simplicity.

A plurality of groups of apertures is provided in each of tubes 120, 121, 122 and 123 communicating between the interior of said tubes and plenum 131. Of these apertures, only apertures 144 in tube 120 and apertures 146 in tube 126 may be seen in the view of FIG. 5.

Groups of apertures are provided in each of tubes 120, 121, 122 and 123 communicating the interiors of said tubes with plenum 130 of which a group of apertures 148 in tube 121 and a group of apertures 150 in tube 120 may be seen in the view of FIG. 5. The positioning, shape, number, longitudinal displacement and other properties of the apertures in tubes 120, 121, 122 and 123 are as described for tubes 10 and 11, 80, 81 and 100 in FIGS. 1–4. Gas is driven by vanes 139 over heating elements 133, 134, 135, 136, 137, 138 in plenum 131 and thence through apertures such as 144 and 146 into each of tubes 120, 121, 122 and 123 as indicated by arrows 151 and is withdrawn from the interior of tubes 120, 121, 122 and 123 to plenum 131 through apertures such as apertures 148 and 150 and thence to vanes 139 as indicated by arrows 152. All apertures are so sized as to shape and position to provide nil outflow of gas and nil inflow of ambient air at both the inlet and outlet ends (the ends not being shown for simplicity in the view of FIG. 5) of tubes 120, 121, 122 and 123.

Referring now to FIG. 6 there is shown a heat treating tube 160 in an embodiment of the device in accordance with the invention. This embodiment illustrates that when serving the function hereinbefore described in conjunction with other embodiments, the plenums need not be provided one within the other. Said other embodiments may provide for minimization of heat loss but embodiments such as that of FIG. 6 may be more economically constructed to provide minimized initial cost. Thus upper plenum 161 may be defined by top wall 162, upper portions of side walls 163 and 164, walls 165 and 166 and tube 160. Lower plenum 167 may be defined by bottom wall 168, lower portions of side walls 163 and 164, walls 165 and 166 and tube 160. Wall 162 may be provided with suitable openings 169 to connect to ducts not shown for simplicity to provide for flow of gas from plenum 161 through openings 169 to blowers 30 and thence to heaters 170 and thence to openings 171 in wall 174 communicating with plenum 167 to provide for flow of gas from the interior of tube 160 through apertures 172 in a wall of tube 160 to blowers 30, as indicated by arrows 173, thence to heaters 170 and thence through plenum 167 and thence into the interior of tube 160 through apertures 174 as indicated by arrows 175. Tube 160 is preferably provided with groups of apertures in addition to groups 174 and 172 which are shown. Each of said groups may be displaced longitudinally in tube 160 with respect to one another and each of said groups in this instance may consist of a plurality of parallel slits or slots. There need be no more than a pair of apertures in each group of course.

Note that the apertures in the groups in the embodiment of FIG. 5 are disposed spirally with respect to one another.

Plenums of the embodiments of FIGS. 1–6 may be considered parts of duct means to introduce and withdraw gas to and from the interiors of the heating treating tubes from the blowers and heaters.

Plenums per se are not necessary. Thus, in the embodiment of FIG. 7, apertures 182 and 184 in opposite walls of heat treating tube 180 communicate from the interior of tube 180 to ducts 190 which communicate with ducts 191 which in turn communicate with ducts 193. Groups of apertures disposed in the same walls of tube 180 as are apertures 182 and 184 may be provided communicating the interior of tube 180 with ducts 192 which may communicate with ducts 191. Longitudinally disposed from aperture groups 182 and 184 are provided apertures 188 in an upper wall of tube 180 and corresponding apertures (not shown for simplicity) opposite thereto in a lower wall of tube 180 communicating the interior of tube 180 with ducts 194. Ducts 194 may communicate with ducts 195 which may in turn communicate with ducts 197. Additional apertures in the same walls of tube 180 as are apertures 188 and the apertures opposite thereto may be provided communicating the interior of tube 180 with ducts 196 which may communicate with ducts 195.

It may be seen that the apertures in the walls of tube 180 which communicate with ducts 190, 194, 192 and 196 are respectively longitudinally displaced in the walls of tube 180 with respect to one another.

Blowers 30 and heaters 170 may be provided together with ducting, not shown for simplicity, to introduce air or other gas from blowers 30 to heaters 170 as indicated by arrows 199, and then to introduce said gas, heated by heaters 170, into ducts 193 as indicated by arrows 185, thence through ducts 191, 190 and 192 into the interior of tube 180 through apertures 182 and 184 and like apertures as indicated by arrows 185, thence through portions of the interior of tube 180 with lateral and longitudinal components over parts to be treated (not shown for simplicity), thence outwardly through apertures 188 and like apertures into ducts 194 and 196 as indicated by arrows 189 and thence through ducts 195 and 197 to blowers 30 as indicated by arrows 185.

Since in all embodiments, as has been mentioned, flow outward of gas from the ends of the heat treating tubes is nil and flow of ambient air into the ends of the heat treating tubes is nil, the device may be operated with a gas therein which is other than air, for example, nitrogen or hydrogen.

It will be apparent to those skilled in the art that equivalents may be utilized.

Accordingly, the present invention may be embodied in other specific forms without departing from the spirit or essential attributes thereof, and accordingly, reference should be made to the appended claims, rather than to the foregoing specification, as indicating the scope of the invention.

It is claimed:

1. In a device for heat treating discrete metal articles the combination of:

a tubular member having an inlet end and an outlet end, said tubular member devoid of closure means at said ends, blower means and heater means to provide heated gas having an elevated temperature and a substantial pressure and velocity, a first group of apertures in the wall of said tubular member provided with duct means to introduce said heated gas into the interior of said tubular member, said duct means to introduce said heated gas to the interior of said tubular member comprising a first plenum chamber, all apertures through which said heated gas is introduced into said tubular member communicating with the interior of said first plenum chamber, a second group of apertures in the wall of said tubular member provided with duct means to withdraw heated gas from the interior of said tubular member to said blower means, said second group of apertures spaced longitudinally in said tubular member with respect to said first group of apertures, said duct means to withdraw heated gas from the interior of said tubular member comprising a second plenum chamber, all apertures through which heated gas is withdrawn from said tubular member communicating with the interior of said second plenum chamber, a third group of apertures in the wall of said tubular member provided with duct means to introduce said heated gas into the interior of said tubular member from said first plenum chamber, said third group of apertures spaced longitudinally in said tubular member with respect to said second group of apertures, a fourth group of apertures in the wall of said tubular member provided with duct means to withdraw heated gas from the interior of said tubular member to said blower means through said second plenum chamber, said fourth group of apertures spaced longitudinally in said tubular member with respect to said third group of apertures.

2. The device of claim 1 characterized by the spacing and location and size of said apertures in said tubular member being pre-selected to provide nil outflow of gas from said tubular member at its ends and nil inflow of ambient air into said tubular member at its ends.

3. The device of claim 2 further characterized by means to sense the presence of a part to be heat treated adjacent to said inlet end of said tubular member and to generate and emit a signal in response to said presence of such part.

4. The apparatus of claim 3 further characterized by means adjacent to the outlet end of said tubular member to sequentially release a part from said device in response to a signal generated by said signal emitted by the means of claim 3.

5. The device of claim 1 wherein said second plenum chamber is substantially contained within said first plenum chamber.

6. The device of claim 5 provided with a plurality of said tubular members.

7. The device of claim 5 wherein said plenum chambers are provided with coextensive end plates.

8. The device of claim 5 wherein said heating means is substantially contained within said second plenum chamber.

* * * * *